US006325014B1

(12) United States Patent
Blanchard

(10) Patent No.: US 6,325,014 B1
(45) Date of Patent: Dec. 4, 2001

(54) MODULAR BOAT HULL AND METHOD OF ASSEMBLY

(75) Inventor: Clarence E. Blanchard, Pleasant Prairie, WI (US)

(73) Assignee: Genmar Holdings, Inc., Minneapolis, MN (US)

( * ) Notice: Subject to any disclaimer, the term of this patent is extended or adjusted under 35 U.S.C. 154(b) by 0 days.

(21) Appl. No.: 09/524,120

(22) Filed: Mar. 13, 2000

(51) Int. Cl.[7] ..... B63B 7/04
(52) U.S. Cl. ..... 114/352; 114/357
(58) Field of Search ..... 114/352, 353, 114/354, 355, 357

(56) References Cited

U.S. PATENT DOCUMENTS 3,400,414 * 9/1968 Windle ..... 114/352
5,301,629 * 4/1994 Kleyh et al. ..... 114/352
5,540,169 * 7/1996 Davis et al. ..... 114/352
5,634,425 * 6/1997 MacDougall ..... 114/357
5,758,594 * 6/1998 Siewert ..... 114/357
5,803,007 9/1998 Stevens ..... 114/266

* cited by examiner

*Primary Examiner*—Stephen Avila
(74) *Attorney, Agent, or Firm*—Dennis M. Flaherty

(57) ABSTRACT

A modular boat hull including bow and stern sections and at least one center section. Preferably these modular sections are rotomolded thermoplastic parts. These modular hull sections can be quickly assembled by coupling a center section to the bow section and then coupling the stern section to the center section. To increase the length of the hull, additional hull center sections can be added as desired. The modular hull sections are coupled by locking arrangements and then secured by installing a support member which bridges the joints between the gunwale sections of adjacent hull sections. Each modular hull section has a lattice for supporting a deck. The deck can be a single piece installed inside the assembled hull. Alternatively, the deck may be modular.

11 Claims, 2 Drawing Sheets

MODULAR BOAT HULL AND METHOD OF ASSEMBLY

FIELD OF THE INVENTION

This invention relates methods of constructing boat hulls.

BACKGROUND OF THE INVENTION

The so-called Jon boat is a conventional boat design that serves a multitude of purposes. It is used commercially as a work boat, and it is also used for fishing and hunting. Current manufacturing practice for the construction of a Jon boat is to make the hull of aluminum. This requires cutting of sheet metal, welding, riveting, labor-intensive assembly practices, and anti-corrosion treatments.

As a result of the conventional construction technique, a Jon boat has a fixed length which cannot be altered once the hull has been fabricated. Due to consumer preferences, it is sound business practice to manufacture and offer for sale a variety of Jon boats having different lengths. For each length, the Jon boat manufacturer must have a respective hull design and a respective hull fabrication procedure. As a result, the manufacturer would need to maintain an inventory of boats or boat hulls of different lengths.

There is a need for a method of manufacturing boat hulls which reduces the manufacturing time and which is environmentally friendly from the recycling standpoint. Preferably such a boat hull would be made of a material which is not susceptible to corrosion. It would also be desirable to provide a modular boat hull the length of which is selected at the time of assembly, thereby obviating the need to maintain an inventory of boat hulls of different lengths.

SUMMARY OF THE INVENTION

The present invention is directed to a modular boat hull comprising a hull bow section, a hull stern section and one or more hull center sections. Preferably these modular sections are rotomolded thermoplastic parts. These modular hull sections can be quickly assembled by coupling a center section to the bow section and then coupling the stern section to the center section. To increase the length of the hull, additional hull center sections can be added as desired, in which case the hull center sections are coupled in series and the hull stern section is coupled to the last hull center section. The modular sections enable a boat dealer and others to assemble boat hulls of various lengths selected at the time of assembly, rather than requiring that boat hulls of different fixed lengths be stored in inventory.

Each modular hull section has a lattice for supporting the deck. The deck can be a single piece installed inside the assembled hull. Alternatively, the deck may comprise deck bow and stern sections designed to fit inside the boat hull of shortest length, and deck center sections designed to be installed between the deck bow and stern sections in boat hulls having greater lengths.

The modular hull sections are coupled by locking arrangements and then secured by installing support members which bridge the joints between the gunwale sections of adjacent hull sections. In accordance with the preferred embodiment, the rear portion of the hull bow section has a female locking portion incorporated on each side; the front portion of the hull center section has a male locking portion incorporated on each side; the rear portion of the hull center section has a female locking portion incorporated on each side; and the front portion of the hull stern section has a male locking portion incorporated on each side. The male locking portions on the hull center section respectively interlock with the female locking portions on the hull bow section; while the male locking portions on the hull stern section respectively interlock with the female locking portions on the hull center section. It will be readily appreciated, however, that the positions of the male and female locking parts can be reversed, e.g., the rear portion of the hull bow section may incorporate a male locking portion on each side while the corresponding female locking portion is incorporated in the front portion of the center section, and so forth. In accordance with the preferred embodiment, the male locking portion is a member (i.e., key) in the shape of a truncated pyramid, whereas the female locking portion is a recess (i.e., lock) having the same shape and dimensioned to receive the key member, preferably with a snug fit. When the key members of one section are inserted in the locking recesses of an adjacent section, the coupled sections are interlocked so that they are unable to move relative to each other in the longitudinal and lateral directions. The coupled sections are then secured to each other, e.g., using extruded aluminum channel moldings which are respectively fastened to the starboard and port gunwales such that the joints between adjacent sections are bridged.

The boat hull disclosed herein has application in power boats and boats which have no propulsion unit. A propulsion unit or outboard motor can be mounted on the rear wall or transom of the boat hull. In accordance with the preferred embodiment disclosed herein, a formed metal plate is affixed to the plastic transom to support an outboard motor.

DETAILED DESCRIPTION OF THE PREFERRED EMBODIMENTS

Figure 1:
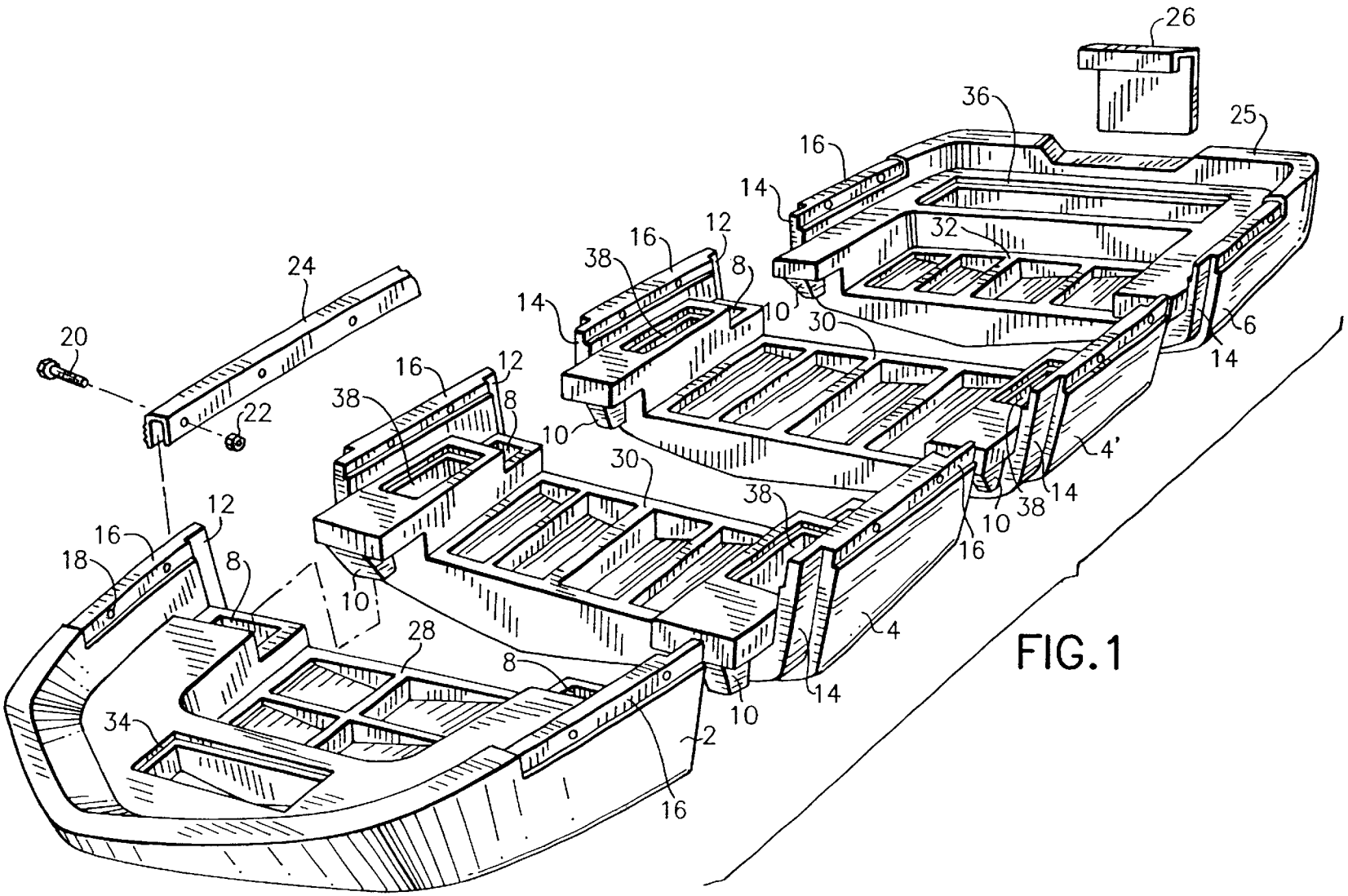
FIG. 1 is a schematic showing an exploded isometric top view of a boat hull in accordance with the preferred embodiment of the present invention.

Referring to FIG. 1 and, a modular boat hull in accordance with one preferred embodiment of the invention comprises a hull bow section 2, two hull center sections 4 and 4', and a hull stern section 6. These hull sections are preferably made of rotomolded thermoplastic material, e.g., polyethylene or polypropylene. In the assembled state shown in FIG. 2, the first hull center section 4 is coupled to the hull bow section 2; the second hull center section 4' is coupled to the first hull center section 4; and the hull stern section 6 is coupled to the second hull center section 4'. Although two center sections are shown, it should be appreciated that a boat in accordance with the preferred embodiment may be constructed with any number of center sections connected in sequence.

The hull sections are connected by interlocking arrangements shown in FIG. 1. In accordance with the preferred embodiment, the rear portion of the hull bow section 2 has a locking recess 8 on each side, while the front portion of the hull center section 4 has a key 10 on each side. As indicated by the dashed line in FIG. 1, the first hull center section 4 is coupled to the hull bow section 2 by inserting the keys 10 of hull center section 4 into the respective locking recesses 8 of hull bow section 2. At the same time, a rear flange 12 incorporated at the rear edge of the hull bow section 2 cooperates with a front flange 14 of the hull center section 4 to form an overlapping. The second hull center section 4' is coupled to the first hull center section 4 in a similar manner. Likewise the hull stern section 6 is coupled to the second hull center section 4' in a similar manner.

In accordance with the preferred embodiment, each key 10 is in the shape of a truncated pyramid, while each locking recess 8 has the same shape and is dimensioned to receive the key 10, preferably with a snug fit. Since both interlocking parts are made of thermoplastic material, the tolerances can be selected so that each key 10 can be wedged inside the corresponding locking recess 8, with the four planar side surfaces of the pyramidal key abutting four opposing planar stop surfaces of the locking recess. These four stop surfaces of the locking recess block relative displacement of the coupled sections in the longitudinal and lateral directions.

Figure 2:
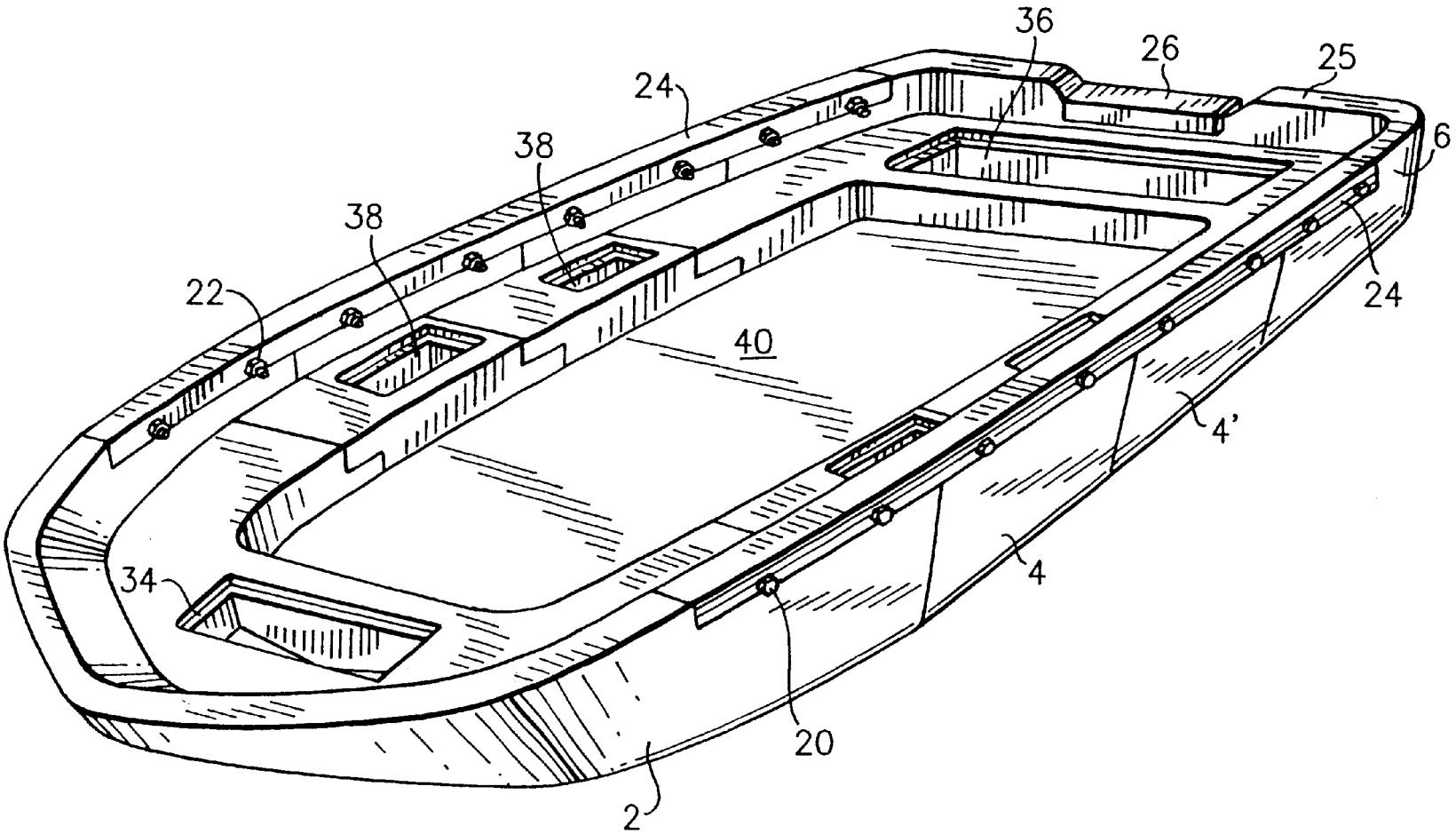
FIG. 2 is a schematic showing an isometric view of a boat (with outboard motor removed) having a modular hull in accordance with the preferred embodiment shown in FIG. 1.

As best seen in FIG. 1, each hull section has starboard and port gunwale sections 16 provided with throughholes 18. When all of the hull sections making up the boat have been connected in sequence as shown in FIG. 2, the gunwale sections 16 are connected in sequence to form starboard and port gunwales. The hull sections are secured together by fastening respective channel moldings 24 to the starboard and port gunwales. In the preferred embodiment, each channel molding 24 comprises a single length of extruded aluminum which extends the entire length of the corresponding gunwale and bridges the joints between adjacent gunwale sections 16. However, the channel molding may also be installed in sections provided that each joint between adjacent gunwale sections is bridged.

As best seen in FIG. 1, the channel molding 24 has a generally U-shaped cross section, the width of the channel preferably being slightly greater than the thickness of the gunwale section. To install the channel molding, the molding is slided over the gunwale sections and then fastened thereto by inserting a respective bolt 20 through each hole 18 and tightening a respective nut 22 on the protruding threaded end of the bolt. In the fully assembled state shown in FIG. 2, the channel moldings fastened to the gunwale sections secure the hull sections together. As a result of this securement, the keys of each hull section are securely retained in the respective locking recesses of the adjacent hull section.

As seen in FIG. 1, each modular hull section has a lattice for supporting a deck. More specifically, the hull bow section 2 has a deck support lattice 28; each hull center section 4, 4' has a deck support lattice 30; and the stern bow section 6 has a deck support lattice 32. When the hull sections are connected in sequence, these lattices form a support for a deck 40 shown in FIG. 2. The deck 40 can be a single piece installed inside the assembled hull. Alternatively, the deck may have a modular construction. For example, the deck may comprise deck bow and stern sections designed to fit inside a boat hull having the shortest length, and deck center sections designed to be installed between the deck bow and stern sections in boat hulls having greater lengths.

Optionally, one or more hull sections may be provided with one or more storage compartments. In the example shown in FIG. 1, the hull bow section 2 has a forward storage compartment 34; each hull center section 4, 4' has a pair of side storage compartments 38; and the stern bow section 6 has an aft storage compartment 36. Although not shown in the drawings, it is obvious that these storage compartment may be provided with hinged covers.

In accordance with the preferred method of manufacture, the modular hull sections are made of rotomolded thermoplastic material. Polyethylene and polypropylene are two examples of suitable thermoplastic materials. The method for rotational molding of the hull sections comprises the step of adding the chosen thermoplastic material to the a mold. The mold is then heated to a temperature in excess of the melting temperature of the thermoplastic material for a predetermined period of time while the mold is rotated. Thereafter, the mold is cooled with a fluid, for example, air or water. The molded modular hull section is then removed from the mold. This method is repeated for each hull section of the boat hull. Different molds are utilized to mold hull bow sections, hull center sections and hull stern sections.

A modular boat hull in accordance with the preferred embodiment can be fabricated using one bow section, one stern sections and any number of center sections. The boat manufacturer or boat dealer can thus reduce fabrication costs and storage costs by stocking only three types of hull sections which can be utilized to fabricate a boat hull of any desired length. Similarly, only three types of deck sections need to be stocked.

The boat hull disclosed herein has application in power boats and boats which have no propulsion unit. A propulsion unit or outboard motor (not shown in FIGS. 1 and 2) can be mounted on the rear wall or transom 25 of the boat hull. During various normal operating conditions, the transom 25 is subjected to relatively large forces transverse thereto. The transom must have sufficient strength to withstand these forces. Indeed, transom-mounted propulsion units impose severe structural stresses on the transom and hull, both because of their own weight and because of the changing torques applied to the boat as the propulsion unit transmits its thrust via the transom. The relatively long upper transom edge is particularly vulnerable to transverse flexure as thrust variations are transmitted thereto via the propulsion unit, which is hung from adjacent the upper transom edge. Similarly, when the propulsion unit strikes underwater obstacles, such as tree stumps, high-impact torques are transmitted to the upper transom edge. In accordance with the preferred embodiment disclosed herein, a formed metal plate 26 is hooked over the upper edge of the transom 25. The metal plate is affixed to the plastic transom to support an outboard motor.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A method of assembling a boat hull, comprising the steps of connecting first through N-th molded thermoplastic hull sections in series, said first molded thermoplastic hull section comprising a bow and said N-th molded thermoplastic hull section comprising a stern, wherein N is an integer greater than or equal to 3, wherein said step of connecting said second molded thermoplastic hull section to said first molded thermoplastic hull section comprises the steps of:

aligning said second molded thermoplastic hull section with said first molded thermoplastic hull section;

coupling said first and second molded thermoplastic hull sections together in a form-fitting engagement;

attaching a first metal member to said coupled first and second molded thermoplastic hull sections on one side thereof; and attaching a second metal member to said coupled first and second molded thermoplastic hull sections on the other side thereof, wherein said first and second metal members respectively bridge said first and second molded thermoplastic hull sections and restrain them against relative movement.

2. The method as recited in claim 1, wherein said coupling step comprises inserting a pair of projections on said second molded thermoplastic hull section into a pair of recesses in said first molded thermoplastic hull section.

3. The method as recited in claim 1, wherein said attaching step comprises fastening one of said metal members to a gunwale section of said first molded thermoplastic hull section and to a gunwale section of said second molded thermoplastic hull section.

4. The method as recited in claim 3, wherein said one metal member comprises a channel molding, further comprising the step of acing said gunwale sections into said channel molding.

5. The method as recited in claim 1, wherein said N-th molded thermoplastic hull section comprises a transom, further comprising the step of hooking a motor mounting plate over an edge of said transom.

6. A boat comprising a hull and a deck supported by said hull, wherein said hull comprises first through N-th molded thermoplastic hull sections connected in series, said first molded thermoplastic hull section comprising a bow and a pair of recesses, said second molded thermoplastic hull section comprising a pair of projections respectively inserted in said recesses of said first molded thermoplastic hull section, and said N-th molded thermoplastic hull section comprising a stern, wherein N is an integer greater than or equal to 3, wherein each of said first through N-th molded thermoplastic hull sections comprises a respective lattice for supporting said deck.

7. The boat as recited in claim 6, wherein said first molded thermoplastic hull section further comprises a first flange and said second molded thermoplastic hull section further comprises a second flange, said first and second flanges being in abutting and overlapping relationship.

8. The boat as recited in claim 6, wherein said first molded thermoplastic hull section further comprises a first gunwale section and second molded thermoplastic hull section further comprises a second gunwale section, further comprising a metal member fastened to said first and second gunwale sections.

9. The boat as recited in claim 8, wherein said metal member comprises a channel molding.

10. The boat as recited in claim 6, wherein said second and (N−1)-th molded thermoplastic hull sections have substantially the same structure.

11. The boat as recited in claim 6, wherein said N-th molded thermoplastic hull section comprises a transom, further comprising a hook-shaped motor mounting plate attached to said transom.

* * * * *

UNITED STATES PATENT AND TRADEMARK OFFICE

CERTIFICATE OF CORRECTION

PATENT NO. : 6,325,014 B1
DATED : December 4, 2001
INVENTOR(S) : Clarence E. Blanchard It is certified that error appears in the above-identified patent and that said Letters Patent is hereby corrected as shown below:

Column 5,
Line 22, substitute -- placing -- for "acing".

Signed and Sealed this

Fourteenth Day of May, 2002

*Attest:*

*Attesting Officer*

JAMES E. ROGAN
*Director of the United States Patent and Trademark Office*